US011103797B2

(12) United States Patent
Krauthamer et al.

(10) Patent No.: US 11,103,797 B2
(45) Date of Patent: Aug. 31, 2021

(54) RIDE CONTROL SYSTEMS AND METHODS FOR AMUSEMENT PARK RIDES

(71) Applicant: Universal City Studios LLC, Universal City, CA (US)

(72) Inventors: Akiva Meir Krauthamer, Orlando, FL (US); Timothy Fitzgerald Garnier, Leesburg, VA (US); Simran Veena Batra, Philadephia, PA (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/889,266

(22) Filed: Jun. 1, 2020

(65) Prior Publication Data

US 2020/0289950 A1 Sep. 17, 2020

Related U.S. Application Data

(63) Continuation of application No. 16/230,538, filed on Dec. 21, 2018, now Pat. No. 10,668,391.

(60) Provisional application No. 62/775,238, filed on Dec. 4, 2018.

(51) Int. Cl.
*A63G 25/00* (2006.01)
*A63G 31/00* (2006.01)

(52) U.S. Cl.
CPC ..... *A63G 25/00* (2013.01)

(58) Field of Classification Search
CPC ..... A63G 31/00; A63G 31/02; A63G 31/04; A63G 33/00; A63G 25/00; B60R 2021/0097
USPC ..... 472/13, 43, 59–61, 130; 434/29
See application file for complete search history.

(56) References Cited

U.S. PATENT DOCUMENTS

| | | | |
|---|---|---|---|
| 5,403,238 | A | 4/1995 | Baxter et al. |
| 5,866,813 | A | 2/1999 | Nakaya et al. |
| 6,007,338 | A | 12/1999 | DiNunzio et al. |
| 6,386,984 | B1 | 5/2002 | Hara et al. |
| 6,796,908 | B2 | 9/2004 | Weston |
| 7,749,089 | B1 | 7/2010 | Briggs et al. |
| 8,179,337 | B2 | 5/2012 | Wilzbach et al. |
| 9,352,225 | B2 * | 5/2016 | Ruke ..... A63F 13/323 |

(Continued)

OTHER PUBLICATIONS

PCT/US2019/063978 International Search Report and Written Opinion dated Feb. 28, 2020.

*Primary Examiner* — Kien T Nguyen
(74) *Attorney, Agent, or Firm* — Fletcher Yoder, P.C.

(57) ABSTRACT

A control system includes a ride controller configured to maintain a plurality of rules indicative of permitted states of the free-roaming ride vehicle within a game area and including gameplay rules. The ride controller is configured to receive monitoring data indicative of a current state of a free-roaming ride vehicle, receive a signal indicative of a user request to perform a requested action with the free-roaming ride vehicle, model performance of the requested action from the current state to determine a modeled state of the free-roaming ride vehicle, and determine whether the modeled state complies with the plurality of rules. In response to determining the modeled state does not comply with the plurality of rules, the ride controller is configured to determine a proximate action that complies with the plurality of rules and provide a control signal to instruct the free-roaming ride vehicle to perform the proximate action.

20 Claims, 3 Drawing Sheets

(56) References Cited

U.S. PATENT DOCUMENTS

| | | | | |
|---|---|---|---|---|
| 9,459,621 | B2 * | 10/2016 | Grant | G05D 1/0027 |
| 9,463,379 | B1 | 10/2016 | Brister et al. | |
| 9,610,510 | B2 | 4/2017 | Comploi | |
| 9,873,058 | B2 | 1/2018 | Magrath, III | |
| 9,908,056 | B2 | 3/2018 | Maycock et al. | |
| 10,527,428 | B1 | 1/2020 | Mehta | |
| 2006/0052106 | A1 | 3/2006 | Park | |
| 2010/0280660 | A1 | 11/2010 | Hasenzahl | |
| 2014/0129074 | A1 | 5/2014 | Boshears et al. | |
| 2015/0246290 | A1 | 9/2015 | De-Gol | |
| 2016/0089610 | A1 | 3/2016 | Boyle et al. | |
| 2018/0369702 | A1 * | 12/2018 | Hake | A63G 31/02 |

* cited by examiner

RIDE CONTROL SYSTEMS AND METHODS FOR AMUSEMENT PARK RIDES

CROSS REFERENCE TO RELATED APPLICATION

This application is a continuation of U.S. Non-Provisional application Ser. No. 16/230,538, entitled "RIDE CONTROL SYSTEMS AND METHODS FOR AMUSEMENT PARK RIDES," filed on Dec. 21, 2018, which claims priority from and the benefit of U.S. Provisional Application Ser. No. 62/775,238, filed Dec. 4, 2018, entitled "RIDE CONTROL SYSTEMS AND METHODS FOR AMUSEMENT PARK RIDES," which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Various amusement rides have been created to provide passengers with unique motion and visual experiences. For example, theme rides can be implemented with single-passenger or multi-passenger ride vehicles that travel along a fixed path or variable path. To provide consistent and efficient passenger experiences, traditional theme rides generally provide passengers a limited amount of control over the ride vehicles, such as interacting with buttons or display devices, or steering the ride vehicles along a narrow channel or track. Moreover, during traditional theme rides in which the passengers can steer their ride vehicles, the ride vehicle generally follows a fixed progression of linear events, such that passengers view scenes in a desired order. In some cases, human operators are tasked with monitoring and managing movement of the ride vehicles through the traditional theme rides; however, such monitoring may be costly and/or provide irregular coverage of the ride vehicles. Accordingly, it is now recognized that there is a need for an improved amusement ride that provides greater freedom of ride vehicle movement to create a more adventurous ride experience.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

Present embodiments are directed toward a control system for controlling a free-roaming ride vehicle of an amusement park ride, including a ride controller configured to maintain a plurality of rules indicative of permitted states of the free-roaming ride vehicle within a game area of the amusement park ride. The plurality of rules includes a plurality of gameplay rules. The ride controller is configured to receive monitoring data indicative of a current state of the free-roaming ride vehicle within the game area, receive a signal indicative of a user request to perform a requested action with the free-roaming ride vehicle, model performance of the requested action from the current state to determine a modeled state of the free-roaming ride vehicle, and determine whether the modeled state complies with the plurality of rules. In response to determining the modeled state does not comply with the plurality of rules, the ride controller is configured to determine a proximate action that complies with the plurality of rules and provide a control signal to instruct the free-roaming ride vehicle to perform the proximate action.

Present embodiments are directed toward an amusement park ride including a ride controller having one or more memories storing a plurality of rules indicative of permitted states of a plurality of free-roaming ride vehicles within a game area of the amusement park ride. The plurality of rules include a plurality of operational rules indicative of a plurality of normal operating parameters for the plurality of free-roaming ride vehicles and a plurality of gameplay rules indicative of a plurality of permitted combinations by which gameplay actions are performable within the game area. The ride controller is configured to receive sensor data indicative of respective current states of the plurality of free-roaming ride vehicles. The amusement park ride also includes a free-roaming ride vehicle of the plurality of free-roaming ride vehicles having a ride vehicle controller communicatively coupled to the ride controller. The ride vehicle controller is configured to provide a signal indicative of a requested action to the ride controller, and in response to the ride controller modeling performance of the requested action from a respective current state of the free-roaming ride vehicle to determine a modeled state of the free-roaming vehicle and determining that the modeled state does not comply with the plurality of rules, receive a control signal from the ride controller indicative of a proximate action that does comply with the plurality of rules and perform the proximate action.

Present embodiments are directed toward a tangible, non-transitory, machine-readable medium, including machine-readable instructions that, when executed by one or more processors, cause the one or more processors to receive sensor data indicative of a current state of a free-roaming ride vehicle within a game area of an amusement park ride. The current state of the free-roaming ride vehicle includes a position, an orientation, a speed, or a combination thereof of the free-roaming ride vehicle. The machine-readable instructions are configured to cause the one or more processors to receive user input indicative of a request to perform a requested action with the free-roaming ride vehicle, model performance of the requested action from the current state to determine a modeled state of the free-roaming ride vehicle, and determine whether the modeled state complies with a plurality of gameplay rules and a plurality of operational rules. In response to determining that the modeled state does not comply with the plurality of gameplay rules and the plurality of operational rules, the machine-readable instructions are configured to cause the one or more processors to determine a proximate action having a proximate modeled state that complies with the plurality of gameplay rules and the plurality of operational rules, and provide a control signal to instruct the free-roaming ride vehicle to perform the proximate action.

BRIEF DESCRIPTION OF DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
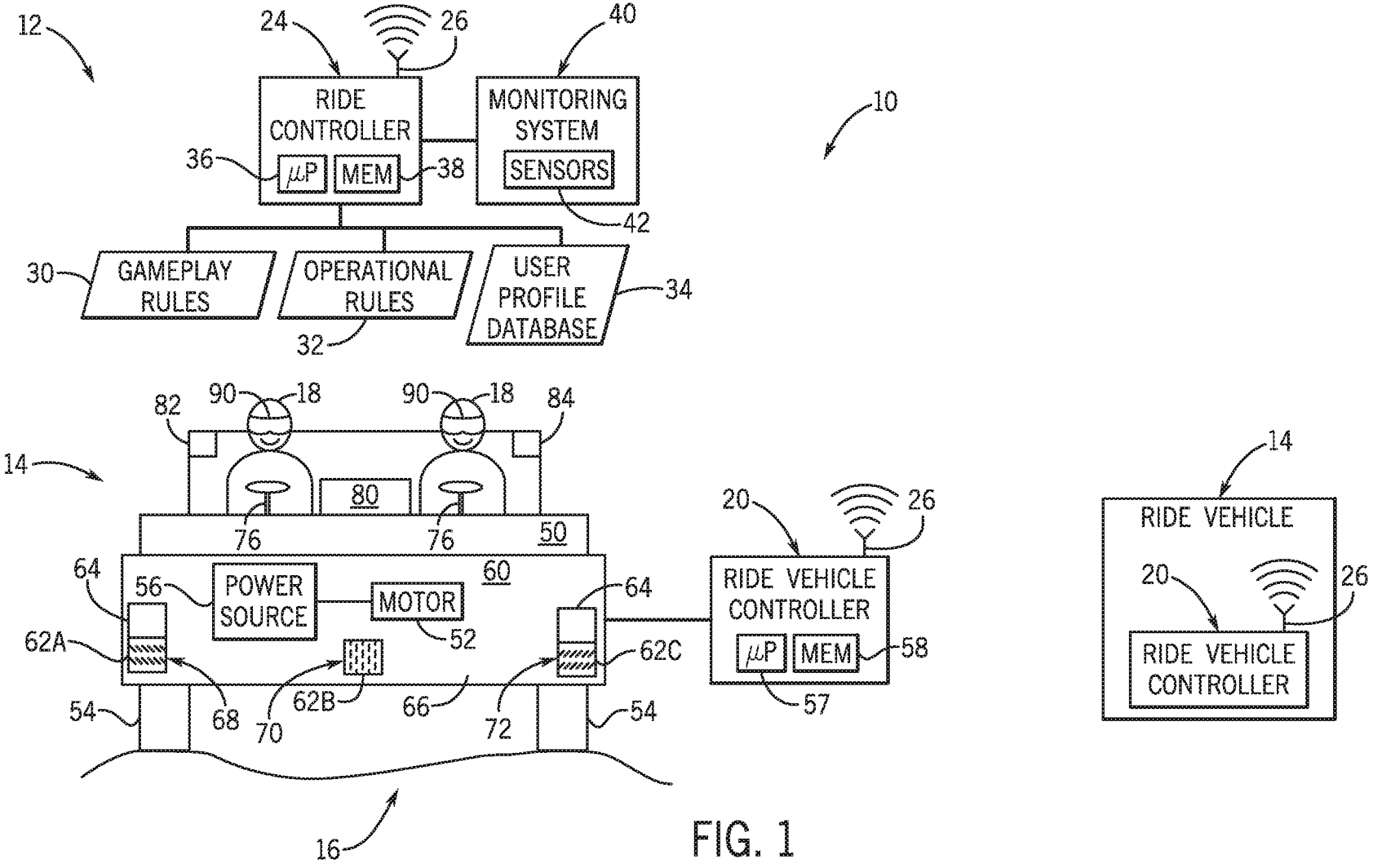
FIG. 1 is a schematic diagram illustrating an embodiment of an amusement park ride having a ride control system and a free-roaming ride vehicle, in accordance with embodiments of the present approach.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments are directed to a ride control system for an amusement park ride. Notably, the amusement park ride includes free-roaming ride vehicles, defined for use herein as vehicles that are generally controllable by passengers to enable the passengers to move freely within an area by controlling their own direction, speed, and so forth (e.g., without tracks or predefined ride paths). As such, the free-roaming ride vehicles each have a set of controls to allow passengers to provide user input regarding their desired path or interactions with the amusement park ride. To provide an enjoyable and reliable experience, some or all of the user input is received by the ride control system as a requested action (e.g., requested movement, requested interaction), instead of as a reflexively performed action. Indeed, in certain embodiments, the ride control system maintains a set or plurality of rules, including gameplay rules that describe permitted, multi-variate combinations of non-linear game events within the amusement park ride and operational rules that describe permitted physical operations of the free-roaming ride vehicle. In some embodiments, the ride control system simulates the requested actions within a multi-dimensional logical space defined by the gameplay rules and the operational rules for the free-roaming ride vehicle. The ride control system is therefore able to compute (e.g., determine, predict) whether the requested action would result in a state of the ride vehicle that is within or complies with the normal operating parameters. When the ride control system determines that the predicted outcome from the requested action does not fall within or comply with the rule set of allowable actions and/or states, the ride control system disallows the requested action. Moreover, the ride control system may select a suitable proximate action, defined herein as any suitable action within the logical space that provides an outcome that is responsive to the user inputs provided by the passenger, while remaining inside of the allowed set of rules, as discussed herein.

By providing an intervening layer of supervision between receiving the user-requested actions and performing the user-requested actions, the ride control system screens and adjusts actions that are not within normal operating conditions for the ride vehicle and/or that disobey the set of gameplay rules set for the amusement park ride. The actions performed by the ride vehicle are, however, responsive to the user-requested actions. Accordingly, the ride control system is able to allow multiple passengers to have their own self-directed, responsive experiences at the same time, while maintaining machine operation within normal operating parameters and keeping experiences regulated to meet and respect predetermined limits and bounds of the amusement park ride.

As illustrated in FIG. 1, an amusement park ride 10 includes a ride control system 12 having multiple free-roaming ride vehicles 14 (hereinafter, "ride vehicles 14") moveable within a game area 16. The present discussion of the amusement park ride 10 focuses on an embodiment in which the amusement park ride 10 is a dark ride, such as an enclosed or indoor space in which effects and interactions provided to passengers 18 are controlled and/or themed. However, the amusement park ride 10 may be any suitable type of ride having any suitable type or number of ride vehicles (e.g., 3, 4, 5, 6, or more) operational therein. The illustrated ride vehicles 14 each include a ride vehicle controller 20 of the ride control system 12 that controls movement of the respective ride vehicle 14 based on input from passengers 18 within the ride vehicle 14 and/or based on input from a ride controller 24 of the ride control system 12. The ride controller 24 and ride vehicles 14 communicate via any suitable, respective communication circuitry 26 (e.g., forming a wireless network). In other embodiments, the ride controller 24 or components thereof may be included within each ride vehicle 14. In certain of these embodiments, the ride vehicles 14 autonomously perform the techniques disclosed herein to operate as self-contained, self-directing, or independent agents communicatively coupled to one another for peer-to-peer communication and coordination.

The ride controller 24 of the present embodiment of the ride control system 12 is a main or central controller that coordinates progression of the ride vehicles 14 through the game area 16. Generally, the ride controller 24 is responsible for validating user inputs the passengers 18 provide to their associated ride vehicle 14. For example and as discussed in more detail herein, the ride controller 24 of certain embodiments models a predicted state (e.g., modeled state) of the ride vehicle 14 that would result after performance of the requested user input. The ride controller 24 therefore compares the modeled state of the ride vehicle 14 to gameplay rules 30 and operational rules 32 to determine whether the requested user input is indicative of a permitted action or gameplay action. Then, in response to determining that the requested action (e.g., requested gameplay action) is permitted, the ride controller 24 instructs the ride vehicle controller 20 to perform the requested action. In response to determining that the user input is indicative of an action that is not permitted, such as attempting to access a second station within the game area 16 without visiting a first, prerequisite station within the game area 16, the ride controller 24 determines a proximate action (e.g., a "next closest" gameplay action) that does abide by the gameplay rules 30 and the operational rules 32. In some embodiments, the proximate action is a manufactured (e.g., corrective)

action that steers or redirects the ride vehicle 14 to a target location or into a target state in response to a condition being met (e.g., ride vehicle 14 stationary for threshold time, moving away from target area). In some embodiments, the ride controller 24 determines the proximate action based on a proximate modeled state of the ride vehicle 14 that is within a threshold of the modeled state. For example and as used herein, a proximate action is an action that is allowed according to respective rules and is responsive to the action requested by the passengers 18. In some embodiments, the ride controller 24 instructs the ride vehicle 14 to perform the proximate action instead of the requested action. As used herein, "gameplay actions" (or simply "actions") refer to any suitable movement of the ride vehicle 14 or action that is requested or performed by passengers 18 within the ride vehicle 14 throughout a duration of the amusement park ride 10.

The gameplay rules 30 of the various embodiments disclosed herein describe permitted combinations of actions available within the game area 16. That is, in certain embodiments, the presently disclosed amusement park ride 10 includes multiple, overlapping solutions or conclusions that may be reached by various non-linear paths or combinations of actions, as set forth by the gameplay rules 30. By way of example, the gameplay rules 30 of certain embodiments specify that a first interactive object is to be activated by passengers 18 of one of the ride vehicles 14 before the ride vehicle 14 is allowed to enter a room containing a second interactive object and a third interactive object. Based on activation of either the second or the third interactive objects, the gameplay rules 30 specify which of multiple exits from the room the ride vehicle 14 is permitted to access. Accordingly, should the passengers 18 attempt or request to direct the ride vehicle 14 through an unauthorized exit, the ride controller 24 instructs the ride vehicle 14 to perform a proximate action, such as blocking forward progress of the ride vehicle 14 through the unauthorized exit and/or providing sensory or physical (e.g., visual, audible, haptic) feedback indicative of a suggested exit. In some cases, the ride controller 24 provides responsive feedback to the passengers 18 indicative of receipt of their requested action that the ride controller 24 is unauthorized or unable to perform. These and other gameplay rules 30 are further discussed below with reference to FIGS. 2 and 3.

The ride controller 24 also maintains operational rules 32 that describe permitted operation, or normal operating parameters indicative of normal operation, of the ride vehicle 14. For example, the operational rules 32 of certain embodiments specify for each ride vehicle: a speed limit, a minimum distance to be maintained between the ride vehicle 14 and other physical objects (including other ride vehicles 14) within the game area 16, a maximum yaw, pitch, and/or roll angle, a minimum battery charge, and/or any other suitable physical property, specification, or restriction of the ride vehicles 14. The operational rules 32 are customized in some embodiments based on the individual ride vehicle 14 and/or the passengers therein, such that ride vehicles 14 operated by more experienced passengers are drivable at faster speeds than similar ride vehicles operated by less experienced passengers.

Further, to maintain a log of relevant information related to a passenger's experience within the amusement park ride 10 and/or an amusement park having the amusement park ride 10, the ride controller 24 of the present embodiment includes and updates a user profile database 34. For such embodiments, the user profile database 34 stores a user profile for each guest to the amusement park and/or passenger 18 within the amusement park ride 10, although other embodiments may include one profile for a group of passengers (e.g., families, friends, schools). In some embodiments, the user profile for each passenger may include an age, a height, a list of previous visits to the amusement park ride 10, a list of actions completed during any previous visits to the amusement park ride 10, and so forth. With this information, the ride controller 24 may provide an adaptive and age-appropriate experience to each passenger 18. Additionally, for certain cases in which the passengers 18 previously completed actions within the amusement park ride 10, the ride controller 24 enables the passengers 18 to continue from a previous or saved point within the game area 16, such as a previously unlocked portion of the game area 16.

The ride controller 24 of the illustrated embodiment includes a processor 36 to provide instructions through the communication circuitry 26 to the ride vehicles 14, as well as a memory 38 (e.g., one or more memories) to store the gameplay rules 30, the operational rules 32, and the user profile database 34. However, it is to be understood that any components can be suitably stored in and updated from any suitable location, such as within a cloud database, within the ride vehicle controllers 20, and so forth. The processor 36 is any suitable processor that can execute instructions for carrying out the presently disclosed techniques, such as a general-purpose processor, system-on-chip (SoC) device, an application-specific integrated circuit (ASIC), or some other similar processor configuration. In some embodiments, these instructions are encoded in programs or code stored in a tangible, non-transitory, computer-readable medium, such as the memory 38 and/or other storage circuitry or device.

Moreover, the ride controller 24 of the present embodiment is communicatively coupled to a monitoring system 40 of the ride control system 12 that provides data related to the state of each ride vehicle 14. For example, the state of each ride vehicle 14 is defined in some embodiments as a position, orientation, speed, battery charge, weight, and/or any other suitable parameters of the ride vehicle 14. Moreover, the monitoring system 40 of certain embodiments also monitors positions, orientations, and/or actions of the passengers 18 within the ride vehicles 14, such that feedback can be provided to the passengers 18 to reduce prohibited or undesirable user interactions (e.g., attempts to exit the ride vehicle 14). The monitoring system 40 therefore includes sensors 42 to collect suitable information related to the state of each ride vehicle 14 and/or the passengers 18 therein. The sensors 42 of certain embodiments include motion trackers, visual cameras, infrared (IR) cameras, radio-frequency identification (RFID) sensors, pressure mats, light curtains, and/or other suitable sensors for monitoring the ride vehicles 14 and the passengers 18 of the amusement park ride 10. In some embodiments, the sensors 42 also monitor other portions of the amusement park ride 10 (e.g., doors, robots, game area 16). The sensors 42 of some embodiments are disposed within the game area 16, such as in a ceiling or side wall of the game area 16, although the monitoring system 40 and the sensors 42 thereof may be disposed in any suitable location in other embodiments.

With the above understanding of the ride controller 24 and monitoring system 40, further details are discussed below regarding the ride vehicles 14. For clarity, the following features of the ride vehicles 14 are illustrated with reference to one ride vehicle 14, although it is to be understood that the other or additional free-roaming ride vehicles 14 of the amusement park ride 10 may include similar or different sets of features. The ride vehicle 14 of the illustrated embodiment includes a main body 50 to house the passengers 18 and a motor 52. The motor 52 selectively drives wheels 54 of the ride vehicle 14 based on control signals (e.g., communication signals, electric signals) provided from a power source 56 of the ride vehicle 14 and/or a processor 57 (e.g., microprocessor) of the ride vehicle controller 20. The ride vehicle controller 20 also includes a memory 58 for storing any suitable information or instructions to be performed by the processor 57. Moreover, the power source 56 may be any suitable high density battery pack, in certain embodiments. The illustrated embodiment of the ride vehicle 14 includes a bumper 60 surrounding a perimeter of the main body 50 of the ride vehicle 14 to reduce physical contact of the main body 50 of the ride vehicle 14 with other objects within the game area 16. In other embodiments, the ride vehicle 14 excludes the bumper 60 and/or includes any other suitable physically protective components.

To enable more efficient visualization and tracking by the monitoring system 40, the ride vehicle 14 of the embodiment illustrated in FIG. 1 includes visual indicators 62 and IR devices 64 coupled to a front surface 66 or portion of the bumper 60. The visual indicators 62 are any suitable fiducial markers that the sensors 42 of the monitoring system 40 are capable of using as a point of reference for determining information regarding the state (e.g., position, location, orientation) of the ride vehicle 14. For example, in the present embodiment, a first visual indicator 62A (e.g., light source or reflector) having a first visual appearance is disposed on a first portion 68 of the bumper 60, a second visual indicator 62B having a second visual appearance is disposed on a second portion 70 or central portion of the bumper 60, and a third visual indicator 62C having a third visual appearance is disposed on a third portion 72 of the bumper 60. Moreover, the IR devices 64, including IR emitters and/or IR reflectors, are disposed on the bumper 60 of the illustrated embodiment of the ride vehicle 14 to selectively emit respective IR signals that enable the monitoring system 40 to identify the state of the ride vehicle 14. In other embodiments, the ride vehicle 14 includes any other suitable combination of identification features to enable tracking by the monitoring system 40.

Further, looking to additional components that enhance passenger 18 experience within the amusement park ride 10, for the present embodiment, the ride vehicle 14 includes an input device 76 for each passenger 18, through which the passengers 18 may request to perform actions with the ride vehicle 14 and/or with interactive features of the game area 16. Although illustrated as a steering wheel, it is to be understood that the input device 76 may additionally or alternatively include any other suitable input device or combination of devices, such as a joystick, a clutch, a gearshift, a gas pedal, a brake pedal, a hand brake, a series of buttons or switches, and so forth. The illustrated embodiment of the ride vehicle 14 also includes a display device 80 (e.g., a touch display device) to display information to and receive user input from the passengers 18. For embodiments of the amusement park ride 10 in which the ride vehicle 14 includes two passengers 18, the ride vehicle controller 20 may receive input from both passengers 18 simultaneously and/or may distribute control of the ride vehicle 14 between the two passengers 18. For example, one passenger 18 may be responsible for interacting with features of the game area 16, and the other passenger 18 may be responsible for driving the ride vehicle 14. In some embodiments, the ride vehicle controller 20 may update the respective control each passenger 18 has over the ride vehicle 14 based on a current time of the amusement park ride 10, passenger 18 acquisition of an item or completing a task, and so forth.

As recognized herein, the ride control system 12 determines whether modeled actions are permitted or comply with both the gameplay rules 30 and the operational rules 32 before enabling performance of the requested actions. For example, the ride vehicle controller 20 receives the user input indicative of a requested action from the input device 76, and transmits signals indicative of the requested action to the ride controller 24 via the communication circuitry 26 for validation. The monitoring system 40 of certain embodiments simultaneously provides data indicative of the state of the ride vehicle 14 and/or other portions of the amusement park ride 10 to the ride controller 24. The ride controller 24 therefore models performance of the modeled action from the state of the ride vehicle 14 and determines whether a modeled state of the ride vehicle 14 resulting from modeled action would comply with the gameplay rules 30 and the operational rules 32.

To provide feedback indicative of whether the modeled action is permitted, the ride vehicle 14 may include any suitable output devices, such as the display device 80, a speaker 82, or a physical feedback device 84 (e.g., vibration device, haptic device, odor emitting device). The passengers 18 of the present embodiment may also be equipped with wearable visualization devices 90 that are communicatively coupled to the ride controller 24 and the ride vehicle controller 20. The wearable visualization devices 90 render virtual objects within the game area 16 using augmented reality (AR), (and/or virtual reality (VR) in some embodiments) to further contribute to a theme or gameplay of the amusement park ride 10, example embodiments of which are described below.

Figure 2:
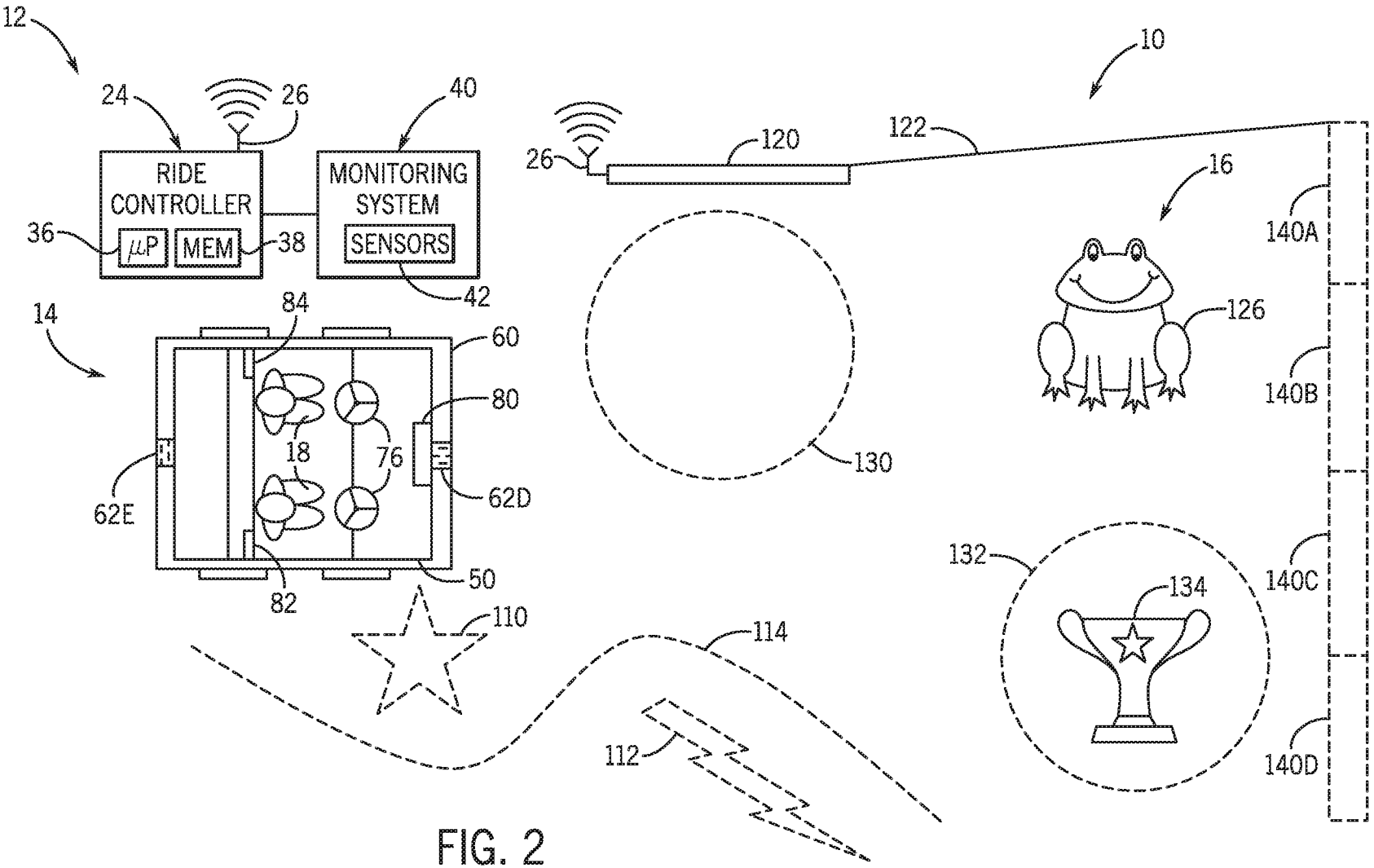
FIG. 2 is a schematic diagram illustrating an embodiment of the free-roaming ride vehicle of FIG. 1 interacting with a game area of the amusement park ride, in accordance with embodiments of the present approach.

For example, FIG. 2 is a schematic diagram illustrating a top-down view of an embodiment of the amusement park ride 10, represented as a dark ride. As such, the game area 16 is generally confined within a building to control events and displays presented to passengers 18 during the amusement park ride 10. One of the ride vehicles 14 discussed above is presently illustrated within the game area 16 as having the two passengers 18 that provide input via the input devices 76 to request performance of actions via the ride vehicle 14. In the present top-down view of the amusement park ride 10, the illustrated embodiment of the ride vehicle 14 includes a front, fourth visual indicator 62D and a back, fifth visual indicator 62E, each disposed on respective upper portions of the bumper 60 to facilitate monitoring aspects (e.g., orientation, speed, position) of the ride vehicle 14 by the sensors 42 of the monitoring system 40. As discussed above, the ride vehicle 14 is a free-roaming ride vehicle from which the passengers 18 may request certain actions to influence the path of the ride vehicle 14 and/or a progression of events within the game area 16.

The embodiment of the amusement park ride 10 illustrated in FIG. 2 includes various interactive features that cooperate to provide a multi-solution path through the game area 16. As such, the passengers 18 of each ride vehicle 14 are able to select their own paths through (and corresponding solutions of) the amusement park ride 10, contributing to user experience and independence within the amusement park ride 10. As mentioned above, the allowed paths or combinations of actions through the game area 16 are defined by the gameplay rules 30 maintained by the ride controller 24. In some embodiments, the amusement park ride 10 enables the passengers 18 of the ride vehicle 14 to complete game objectives that define an individualized game result, determined as one of multiple (e.g., 2, 3, 4, 5, 6, or more) game results.

For the example embodiment of FIG. 2, the illustrated interactive features of the game area 16 include a first interactive object 110 separated from a second interactive object 112 by an interactive boundary wall 114. In the present embodiment, the interactive objects 110, 112 are virtual objects that are displayed as disposed within the game area 16 by the wearable visualization devices 90 of each passenger 18. The interactive boundary wall 114 of the present embodiment is a virtual effect manifested as a force field wall through which the ride vehicle 14 is selectively allowed to pass, based on adherence to the gameplay rules 30 and the operational rules 32. In other embodiments, the interactive objects 110, 112 may be presented within the physical space of the game area 16 by projectors or hologram generators, such that the monitoring system 40 informs the ride controller 24 when the ride vehicle 14 drives through or otherwise interacts with the interactive objects 110, 112. In other embodiments, the interactive objects 110, 112 are physical devices communicatively coupled to the ride controller 24, such as actuatable buttons that the passengers 18 may depress with or from the ride vehicle 14 or robots the passengers 18 may interact with.

The gameplay rules 30 of certain embodiments may specify, for example, that the passengers 18 are to drive the ride vehicle 14 over the first interactive object 110 before access is granted to the second interactive object 112. In cases in which the passengers 18 request to drive the ride vehicle 14 through the interactive boundary wall 114 without first driving over the first interactive object 110, the ride controller 24 models the requested action to determine a modeled state that the ride vehicle 14 is expected to be in after performance of the requested action. Because the modeled state does not comply with the gameplay rules 30, the ride controller 24 determines that the requested action is not permitted, and blocks the requested action. In certain embodiments, the ride controller 24 additionally instructs the ride vehicle controller 20 to perform a proximate action identified via modeling as similar to the requested action, such as stopping forward motion of the ride vehicle (e.g., deactivating gas pedal), adjusting an amount of force for manipulating the input device 76 (e.g., to encourage the passengers 18 to steer in a different direction, such as along an outer surface of the interactive boundary wall 114), outputting an alert through an output device (e.g., the display device 80, the speaker 82, the physical feedback device 84) to alert the passengers 18 of the blocked action, or any other suitable control action.

The illustrated game area 16 also includes an electronic display device 120 disposed adjacent to (e.g., within a threshold distance from) a physical wall 122. The illustrated embodiment of the electronic display device 120 also includes the communication circuitry 26 to enable the ride controller 24 to provide control signals thereto; however, it is to be understood that any other suitable display system, such as a projector and a projector screen, may be used in addition or in alternative to the electronic display device 120. In some embodiments, the interactive boundary wall 114 of certain embodiments may be combined with or overlaid onto the electronic display device 120 and the physical wall 122 so that contact between the ride vehicle 14 and the physical wall 122 is reduced or prevented. A robot 126 or animated figure, illustrated as a frog in the embodiment of FIG. 2, is disposed in front of the physical wall 122 to emulate actions of a frog and/or otherwise interact with the passengers 18 within the ride vehicle 14 (e.g., based on control signals provided by the ride controller 24). The robot 126 of other embodiments emulates any other suitable character or brings lifelike characteristics to an otherwise inanimate object.

Additionally, the game area 16 of the illustrated embodiment includes a first interactive station 130 or first gameplay station disposed in front of the electronic display device 120. The game area 16 also includes a second interactive station 132 or second gameplay station, having a reward 134 therein and disposed in front of exits 140 from the game area 16. However, it is to be understood that other embodiments may include rooms, regions, or other areas that are physically or virtually confined from one another by any suitable features of the game area 16, such as interactive boundary walls 114 or physical walls 122. The presently illustrated exits 140 include a first exit 140A, a second exit 140B, a third exit 140C, and a fourth exit 140D in close proximity to one another, though it is to be understood that the game area 16 may include any suitable number of exits separated by any suitable distances.

By way of example, the gameplay rules 30 of certain embodiments specify which exit 140 that the ride vehicle 14 is allowed to pass through based on an order and/or a quantity of actions completed within the game area 16. For example, the gameplay rules 30 of certain embodiments specify that the reward 134 in the second interactive station 132 is unlocked only after the ride vehicle 14 has visited the first interactive station 130 and/or been provided a presentation on the electronic display device 120. The gameplay rules 30 of these embodiments may further specify that the ride vehicle 14 can interact with the robot 126 at any time during a duration of the amusement park ride 10. Based on an order of the actions completed by the passengers 18, the ride controller 24 unlocks (e.g., deactivates a corresponding interactive boundary wall, instructs a physical door or gate to open) one or multiple of the exits 140. The exits 140, reward 134, or any other suitable portions of the game area 16 are unlocked (e.g., corresponding interactive boundary walls 144 deactivated) in some embodiments based on both the past achievements (as stored within the user profile database 34) and the present achievements (within the current instance of the amusement park ride 10) of the passengers 18.

Moreover, the ride controller 24 of certain embodiments adaptively updates the gameplay rules 30 based on conditions of the amusement park ride 10. For example, if the first interactive station 130 is overcrowded (e.g., includes a threshold number of ride vehicles 14), the ride controller 24 of certain embodiments updates the gameplay rules 30 to push alerts to the ride vehicles 14 regarding the availability of a quest or task available at an alternative station of the amusement park ride 10 or to direct (e.g., encourage) the passengers 18 to visit the alternative station. The ride control system 12 may therefore effectively control crowds within the amusement park ride 10 to improve passenger 18 experience within the game area 16 and/or passenger 18 throughput or bandwidth. Similarly, if a particular station or portion of the game area 16 is undergoing maintenance or repair, the gameplay rules 30 enforced by the ride controller 24 may be updated to block ride vehicles 14 from approaching the particular station. Moreover, if the particular station included a prerequisite action for subsequent stations, the gameplay rules 30 can be updated (e.g., in advance or on-the-fly) to substitute or remove the prerequisite action from the gameplay rules 30. In some of these embodiments, the ride controller 24 senses when a station is in need of repair and automatically updates the gameplay rules 30 to direct ride vehicles 14 elsewhere by correcting dependencies between stations (e.g., via a topological sort algorithm).

The gameplay rules 30 of certain embodiments are also updated or altered based on a current time period of the amusement park ride 10. For example, the gameplay rules 30 of certain embodiments specify that a first portion of the interactive stations within the game area 16 are accessible during a first time period and that a second portion of the interactive stations within the game area 16 are accessible during a later, second time period. Moreover, the gameplay rules 30 of certain embodiments specify that at the conclusion of the amusement park ride 10, passenger 18 control of the ride vehicles 14 is wholly or partially overridden or denied so that the ride controller 24 provides control signals to autonomously direct the ride vehicles 14 to exit the game area 16.

Figure 3:
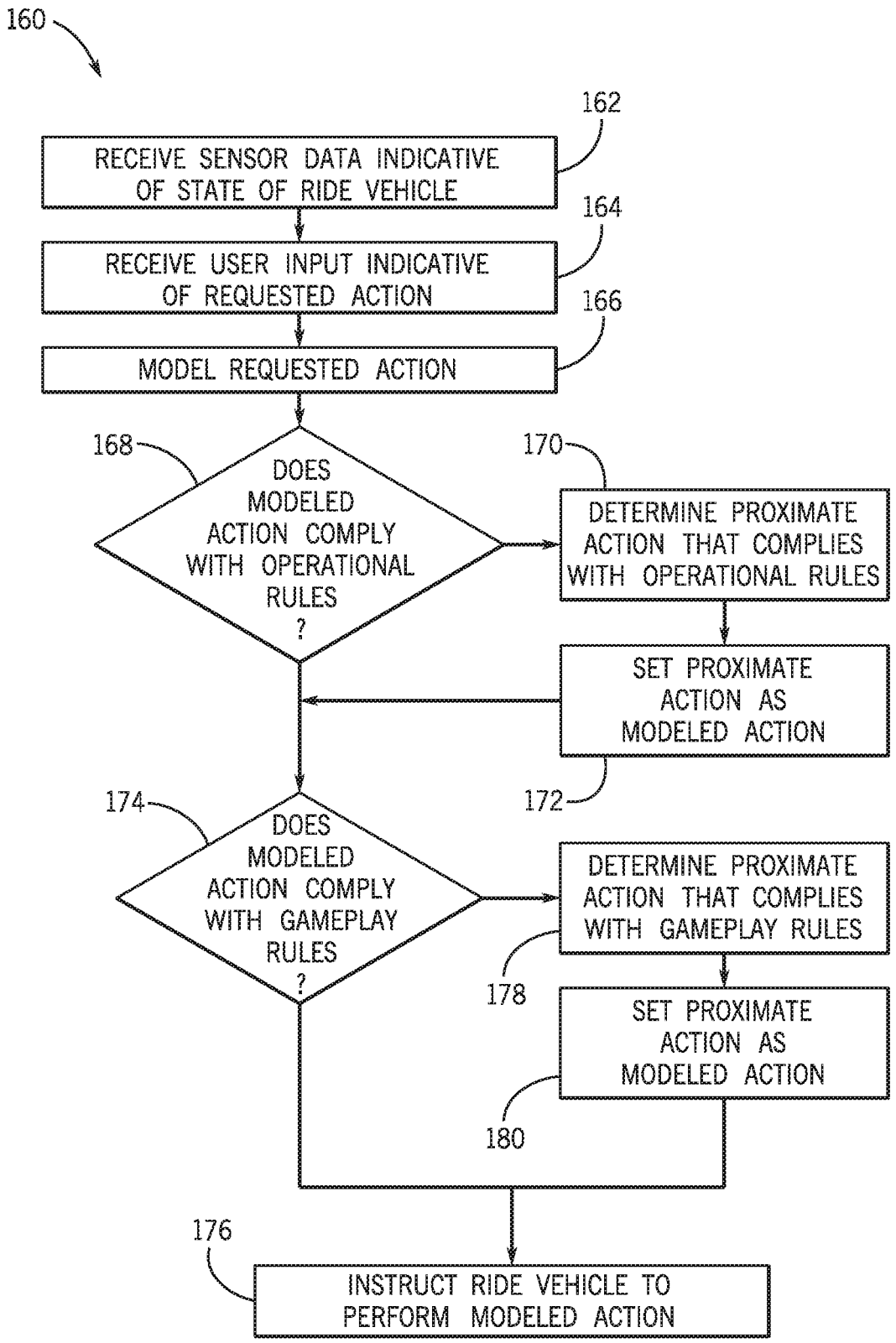
FIG. 3 is a flow diagram illustrating an embodiment of a process for controlling progression of the free-roaming ride vehicle within the game area of FIG. 2, in accordance with embodiments of the present approach.

With reference to the above features of the game area 16 (e.g., interactive objects 110, 112, interactive boundary wall 114, interactive station 130, 132) for discussion purposes, further information is provided herein with reference to operation of the ride control system 12 having the ride controller 24. FIG. 3 is a flow diagram illustrating an embodiment of a process 160 for operating the ride control system 12 to provide a responsive user experience to the passengers 18 within the ride vehicle 14 of the amusement park ride 10. The illustrated embodiment of the process 160 begins with the ride controller 24 receiving (block 162) sensor data indicative of a state of the ride vehicle 14, such as from the monitoring system 40 discussed above. Indeed, the ride vehicle 14 is a free-roaming device movable between the interactive features discussed above with reference to FIG. 2. The ride controller 24 additionally receives (block 164) user input indicative of a requested action with the ride vehicle 14 and/or with interactive features of the game area 16. For example, the passengers 18 of certain embodiments provide input to attempt to steer the ride vehicle 14 in a certain direction, at a certain speed, into a certain room, and so forth. In some embodiments, the ride controller 24 simultaneously receives the sensor data (from block 162) and the user input (from block 164).

Continuing through the illustrated embodiment of the process 160, based on the user input and the state of the ride vehicle 14, the ride controller 24 models (block 166) the requested action. That is, the ride controller 24 uses any suitable simulation or set of equations to determine a predicted state or modeled state of the ride vehicle 14 after performance (e.g., upon completion) of the requested action. In some embodiments, the predicted state of the ride vehicle 14 may include any suitable parameters representative of an aspect of the state of the ride vehicle 14, such as a predicted position, a predicted speed, a predicted battery charge, a predicted gameplay event that would be completed, or any other suitable data.

After predicting the state of the ride vehicle 14, the ride controller 24 determines (block 168) whether the model of the requested action, or the modeled action, complies with the operational rules 32 set for the ride vehicle 14. For example, as mentioned, the ride controller 24 maintains the set of operational rules 32 that describe permitted physical operation of the ride vehicle 14, including the normal operating parameters thereof. The ride controller 24 compares the modeled action to the operational rules 32 to determine if the resulting predicted state of the ride vehicle 14 is in line with, corresponds to, or complies with the operational rules 32. It is to be understood that any suitable actions, states, or combinations thereof may be compared to the operational rules 32 and the gameplay rules 30.

In response to determining that the modeled action does not comply with the operational rules 32, the ride controller 24 of the ride control system 12 determines (block 170) a proximate action that complies with the operational rules 32. As noted above and described further herein, the proximate action may be selected as the closest action (relative to a logical space of potential actions) that is in line with the operational rules 32 and responsive to the intended result of the modeled action. For example, in some embodiments in which the passengers 18 request to turn the ride vehicle 14 to the left while adjacent to the physical wall 122, the ride controller 24 determines that the operational rules 32 specify that the ride vehicle 14 is not permitted to contact the physical wall 122, and instead determines that the proximate action is to move the ride vehicle 14 forward.

The ride controller 24 following the process 160 therefore sets (block 172) the proximate action as the modeled action. As such, the ride controller 24 can proceed to determine whether the modeled action complies with the gameplay rules 30 as well. In some embodiments, the ride controller 24 solicits passenger 18 approval of the proximate action before setting the proximate action as the modeled action. After determining the modeled action is in line with the operational rules 32, the ride controller 24 proceeds to determine (block 174) whether the modeled action complies with the gameplay rules 30. For example, based on the predicted, modeled state of the ride vehicle 14, the ride controller 24 determines whether performance of the modeled action would result in a predicted, modeled state of the ride vehicle 14 that complies with the gameplay rules 30. In some embodiments, the modeled state is modeled from multi-dimensional logical space mapping including possible permutations of actions, such that prerequisite actions (as discussed above with reference to FIG. 2) are performed before the ride vehicle 14 is permitted to perform subsequent actions. In response to determining the modeled action complies with the gameplay rules 30, the ride controller 24 proceeds directly to instruct (block 176) the ride vehicle to perform the modeled action.

Alternatively, in response to determining the modeled action does not comply with the gameplay rules 30, the ride controller 24 determines (block 178) a proximate action that complies with the gameplay rules 30. That is, the ride controller 24 of certain embodiments selects or identifies the proximate action as an adjacent point in the multi-dimensional logical space, which may be the closest, allowed action having a comparable outcome state, creative intent, or proximate modeled state that is responsive to the modeled action. The ride controller 24 can determine the proximate action as an action having a proximate modeled state that is within a threshold (e.g., distance within the multi-dimensional logical space) of the modeled state determined from the modeled action. As mentioned, the ride controller 24 sets (block 180) the proximate action as the modeled action and instructs (block 176) the ride vehicle 14 to perform the modeled action.

In other embodiments, the ride controller 24 performs the determinations of blocks 168 and 174 simultaneously. In some of these embodiments, the ride controller 24 prioritizes determination of whether the modeled action complies with the operational rules 32 before verifying that the modeled action complies with the gameplay rules 30 to ensure proper operation of the ride vehicle 14 in cases of limited processing power. For example, if the passengers 18 request that the ride vehicle 14 move at a speed outside of the normal operating parameters through the interactive boundary wall 114 (through which the gameplay rules 30 specify the ride vehicle 14 is not presently permitted to drive), the ride controller 24 may first limit the speed of the ride vehicle 14 before providing feedback or control signals in response to the attempted progression through the interactive boundary wall 114. In other embodiments, the ride controller 24 may determine whether the modeled action complies with the gameplay rules 30 before determining whether the modeled action complies with the operational rules 32, or block 168 may be omitted in embodiments in which the ride vehicles 14 are preprogrammed to operate within the operational rules 32 at all times.

As such, technical effects of the disclosed ride control system include improved, individualized passenger control of free-roaming ride vehicles that provide a more immersive and responsive experience to passengers, with reduced reliance on supervising human operators and reduced wear to the components of the amusement park ride. The ride control system further provides improved reliability and operation by improving crowd control and reducing effects of maintenance downtime. Indeed, by receiving passenger-requested inputs as requested actions and verifying the requested actions against both gameplay rules and operational rules, the presently disclosed ride control system generates a responsive gameplay environment in which the passengers may experience self-directed play-throughs within a multi-solution amusement park ride, While only certain features of the disclosure have been illustrated and described herein, many modifications and changes will occur to those skilled in the art. It is, therefore, to be understood that the appended claims are intended to cover all such modifications and changes as fall within the true spirit of the disclosure. It should be appreciated that any of the features illustrated or described with respect to the figures discussed above may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride control system, comprising:

a controller having a memory storing a plurality of operational rules and a plurality of gameplay rules, wherein the controller comprises a processor configured to:

monitor a free-roaming ride vehicle configured to be directed through a game area of an amusement park ride;

receive a rider request to perform an action with the free-roaming ride vehicle;

determine, based on the monitoring, whether a performance of the action follows the plurality of operational rules;

in response to determining that the performance of the action follows the plurality of operational rules, determine, based on the monitoring, whether the performance of the action follows the plurality of gameplay rules; and in response to determining that the performance of the action does not follow the plurality of gameplay rules, determine a proximate action and provide a control signal indicative of the proximate action to the free-roaming ride vehicle, wherein the proximate action comprises a similar creative intent to a creative intent of the action.

2. The ride control system of claim 1, wherein the processor is configured to:

receive an additional rider request to perform an additional action with the free-roaming ride vehicle; and in response to determining that an additional performance of the additional action does not follow the plurality of operational rules, determine an additional proximate action that follows the plurality of operational rules.

3. The ride control system of claim 1, wherein the plurality of operational rules defines a plurality of normal operating parameters indicating permitted operation of the free-roaming ride vehicle.

4. The ride control system of claim 1, wherein the plurality of gameplay rules comprises a plurality of permitted combinations by which gameplay actions are performable within the game area of the amusement park ride.

5. The ride control system of claim 1, wherein the controller is communicatively coupled to a rider profile database, and wherein the processor is configured to:

receive rider information indicative of an identity of a rider of the free-roaming ride vehicle;

query the rider profile database based on the identity to retrieve at least one previous game progression of the rider; and update the plurality of gameplay rules to correspond to the at least one previous game progression.

6. The ride control system of claim 1, comprising a monitoring system configured to detect a current occupancy of each game station of a plurality of game stations defined in the game area, wherein the processor is configured to modify the plurality of gameplay rules to direct the free-roaming ride vehicle to a game station of the plurality of game stations that comprises fewer than a threshold number of other free-roaming ride vehicles.

7. The ride control system of claim 1, comprising an animated figure positioned within the game area and communicatively coupled to the controller, wherein the processor is configured to instruct the animated figure to interact with the free-roaming ride vehicle, and wherein the plurality of operational rules indicates that physical contact between the animated figure and the free-roaming ride vehicle is not permitted.

8. The ride control system of claim 1, wherein the rider request is received from a rider input device of the free-roaming ride vehicle, and wherein the rider input device comprises a steering wheel, a brake, a joystick, or a wearable visualization device.

9. A ride control system of an amusement park ride, wherein the ride control system comprises:

a monitoring system configured to detect a current state of a free-roaming ride vehicle moveable within a game area of the amusement park ride;

a controller having a memory storing a primary set of operational rules and a secondary set of gameplay rules, wherein the controller comprises a processor configured to:

receive a first signal indicative of the current state of the free-roaming ride vehicle from the monitoring system;

receive a second signal indicative of a rider request for the free-roaming ride vehicle to perform an action;

determine whether a performance of the action from the current state follows the primary set of operational rules;

in response to determining that the performance of the action follows the primary set of operational rules, determine whether the performance of the action from the current state follows the secondary set of gameplay rules;

in response to determining that the performance of the action follows the secondary set of gameplay rules, enable the performance of the action; and in response to determining that that the performance of the action does not follow at least one rule of the primary set of operational rules or the secondary set of gameplay rules, provide a stop signal to block the performance of the action.

10. The ride control system of claim 9, wherein the monitoring system comprises at least one sensor configured to provide sensor feedback indicative of a current condition of the game area, and wherein the processor is configured to modify the primary set of operational rules based on the sensor feedback.

11. The ride control system of claim 10, wherein the current condition of the game area comprises a weather condition, a maintenance condition, an occupancy condition, or a combination thereof.

12. The ride control system of claim 10, wherein the processor is configured to:

receive additional sensor feedback from the at least one sensor; and modify the secondary set of gameplay rules based on the sensor feedback.

13. The ride control system of claim 9, wherein the processor is configured to:

determine a proximate action that follows each rule of the primary set of operational rules and the secondary set of gameplay rules; and provide a control signal to instruct the free-roaming ride vehicle to perform the proximate action instead of the blocked action.

14. The ride control system of claim 9, wherein the monitoring system comprises at least one sensor configured to track one or more fiducial markers, infrared devices, wearable visualization devices, or a combination thereof associated with the free-roaming ride vehicle.

15. A method of operating a ride control system, the method comprising:

monitoring, via a controller of the ride control system, a free-roaming ride vehicle positioned within a game area of an amusement park ride;

receiving, via the controller, a rider request to perform an action with the free-roaming ride vehicle;

determining, via the controller, whether a performance of the action follows a set of hierarchical rules, wherein the set of hierarchical rules comprises a first-tier set of operational rules and a second-tier set of gameplay rules;

in response to determining that the performance of the action follows the set of hierarchical rules, enabling, via the controller, the performance of the action; and in response to determining that the performance of the action does not follow at least one rule of the set of hierarchical rules, determining, via the controller, a proximate action and providing a control signal to the free-roaming ride vehicle to trigger a performance of the proximate action.

16. The method of claim 15, comprising determining the proximate action by:

modeling a predicted state of the free-roaming ride vehicle after the performance of the action; and selecting the proximate action as a closest intent match from a multi-dimensional space defined by the set of hierarchical rules.

17. The method of claim 15, comprising instructing, via the controller, a robot character positioned within the game area to interact with a rider of the free-roaming ride vehicle.

18. The method of claim 15, comprising modifying the set of hierarchical rules based on a rider profile of a rider of the free-roaming ride vehicle, wherein the rider profile is associated with a narrower version of the set of hierarchical rules than other rider profiles of the ride control system.

19. The method of claim 15, comprising:

determining that a current game session has concluded; and updating the set of hierarchical rules to enable the free-roaming ride vehicle to travel toward an exit of the game area and to block the free-roaming ride vehicle from traveling further from the exit.

20. The method of claim 19, comprising selecting the exit from a plurality of exits based on progress of the free-roaming ride vehicle through the second-tier set of gameplay rules, before updating the set of hierarchical rules.

* * * * *